United States Patent [19]

Walsh

[11] 4,379,249

[45] Apr. 5, 1983

[54] INCANDESCENT LAMP WITH ELLIPSOIDAL ENVELOPE AND INFRARED REFLECTOR

[75] Inventor: Peter Walsh, Stirling, N.J.

[73] Assignee: Duro-Test, Corporation, North Bergen, N.J.

[21] Appl. No.: 179,718

[22] Filed: Aug. 20, 1980

[51] Int. Cl.[3] ..... H01J 1/14; H01J 1/32

[52] U.S. Cl. ..... 313/112; 313/113; 313/315; 313/578

[58] Field of Search ..... 313/112, 113, 220, 315

[56] References Cited

U.S. PATENT DOCUMENTS 2,144,521 1/1939 Bergmans et al. ..... 313/113

2,218,346 10/1940 Spaeth ..... 313/315 X 4,160,929 7/1979 Thorington et al. ..... 313/112

4,283,653 8/1981 Brett ..... 313/112 X

*Primary Examiner*—Palmer C. Demeo

*Attorney, Agent, or Firm*—Darby & Darby

[57] ABSTRACT

An incandescent electric lamp having an envelope in the shape of an ellipse rotated about a center line and defining a circle of focal points, said envelope having thereon a coating which reflects infrared energy produced by the filament and at least a part of the coating transmitting all or a selected portion of the visible range light energy produced by a filament which is shaped and located so that at least a part of the filament lies on or adjacent to the focal circle so that infrared energy produced by the filament at one focal point on the circle will be reflected by the coating back to another focal point on the circle.

12 Claims, 5 Drawing Figures

INCANDESCENT LAMP WITH ELLIPSOIDAL ENVELOPE AND INFRARED REFLECTOR

BACKGROUND OF THE INVENTION

A variety of incandescent lamps exist for specialized purposes. Once such specialized purpose is a traffic signal lamp in which the lamp is mounted on a fixture which is generally located above the line of sight. Consequently, the filament of such a lamp is designed so that when it is placed in its fixture it will radiate light downward rather than upwardly, where it would be wasted. One such lamp uses a W-shaped filament with the bottom portion of the W located below the central medial plane of a spherical shaped envelope. For traffic purposes, the lamp can either be of clear glass with a filter, such as a colored glass filter, placed in front of it so that the appropriate color would be transmitted, i.e. red, green or yellow. In other types of lamps, the lamp itself is colored, generally with a painted organic pigment color over the lamp envelope.

Work has also been done in connection with improving the efficiency of incandescent lamps by applying to the lamp envelope a visible transmissive-infrared reflective (heat mirror) coating. The envelope of such a lamp is often optically shaped and the coating placed therein will reflect back to the filament a substantial portion of the IR energy that is produced to raise its operating temperature. This in turn reduces the amount of power needed to heat the filament to its operating temperature, thereby increasing the efficiency of the lamp.

The heat mirror coating also transmits a large portion of the visible range energy produced by the filament. One such type of lamp is shown, for example, in the Thorington, et al. U.S. Pat. No. 4,160,909, which is also assigned to the assignee of the subject application in which the coating is a composite of three discrete films of $TiO_2/Ag/TiO_2$ which is capable of transmitting an average over the the visible range of about 60% and above of the visible range energy and reflect an average of about 60% and above of the IR range energy. Other types of such lamps also have been proposed using various other types of coatings than that disclosed in the Thorington, et al patent. Another incandescent lamp using a different type of coating is disclosed in application Ser. No. 45,645, filed June 5, 1979 in the name of Peter Walsh, which is a continuation of application Ser. No. 863,155, filed Dec. 22, 1977, now abandoned, both of which are also assigned to the assignee of the subject application. In that application, the coating is an etalon of a dielectric film sandwiched between two films of silver.

In lamps of the type using a heat mirror coating, theoretically a point source filament precisely located at the optical center of a spherical envelope, for example, would be ideal so that the maximum amount of IR energy reflected by the coating will impinge back onto the filament. However, a point source filament is not reliable and, instead a "compact" filament is used. The term "compact" is meant to mean an elongated filament in which the length to diameter ratio of the filament is made relatively small. Such filament is generally mounted vertically in the envelope with respect to the lamp base.

The use of such a lamp with a heat mirror coating and "compact" filament in a specialized environment, such as a traffic signal lamp, would be somewhat inefficient. Although the overall efficiency of the lamp has been raised by the coating, the light emitted by the filament would not be preferentially directed downwardly. Also, from the point of view of operating life, in general service types of lamps as well as in traffic signal lamps, a compact filament is not as desirable as a C-shaped (or circular shaped) filament, which is the type of filament usually used in general service lamps. Such C-shaped filaments have three mounting supports, one at each end and the third in the center and is quite rugged.

If a C-shaped or circular filament were used in a spherical-shaped envelope having an IR reflective coating, the lamp would be inefficient since all of the filament would be located far from the optical center of the envelope and the IR energy would not be optimally reflected back to the filament.

Accordingly, the present invention is directed to a novel incandescent lamp having a visible transmissive-IR reflective (heat mirror) coating on the envelope in which a filament, such as a C-shaped or circular filament, is used. The envelope is uniquely shaped as an ellipse which is rotated about its center with the two foci of the ellipse forming an infinite number of foci lying in a circle called the focal circle. The filament is located on or near the focal circle so that the energy reflected by the heat mirror coating impinges on it.

The lamp can be utilized with either a heat mirror coating which can transmit light over the entire visible range, or it can be used with a coating such as to produce a selective color. The latter improves doubly the efficiency of the lamp both from the point of view of the IR reflective coating increasing the energy efficiency and the selective color coating being more efficient than a pigment coating and thereby reducing the amount of energy needed to produce a given amount of light at the particular color.

It is, therefore, an object of the present invention to provide an incandescent lamp utilizing an envelope in the shape of an ellipse of revolution with the filament being located on or near the focal circle of the envelope.

A further object is to provide an incandescent lamp having a curved filament located on or near a focal circle of an envelope shaped as an ellipse of revolution, with the lamp having a coating thereon to reflect IR energy back to the filament.

An additional object is to provide an incandescent lamp having an envelope in the shape of an ellipse of revolution with a curved filament located on or near a focal circle defined by the ellipse, with the coating also transmitting only a selected color portion of the visible light.

Other objects and advantages of the present invention will become more apparent upon reference to the following specification and annexed drawings in which.

Figure 1A:
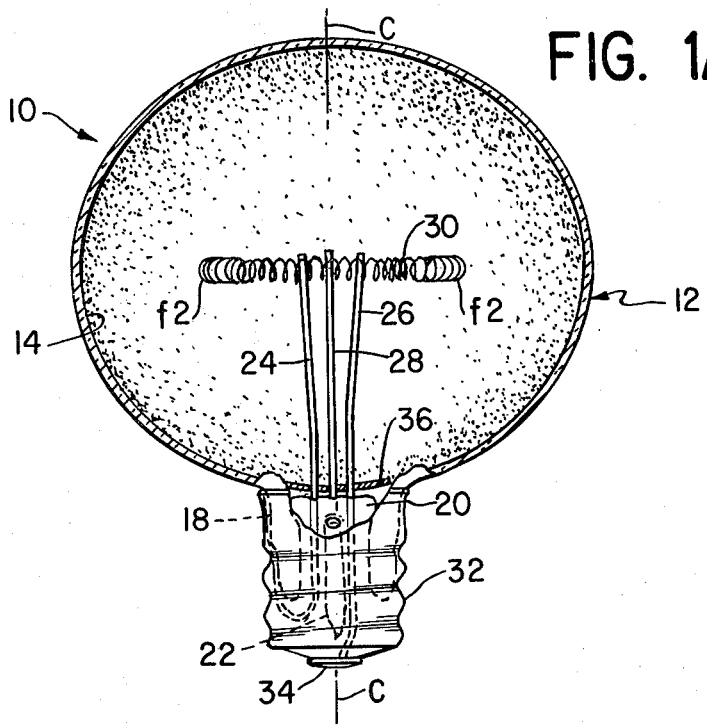
FIG. 1A is an elevational view, partly in cross section, showing a lamp in accordance with the invention.
Figure 1B:
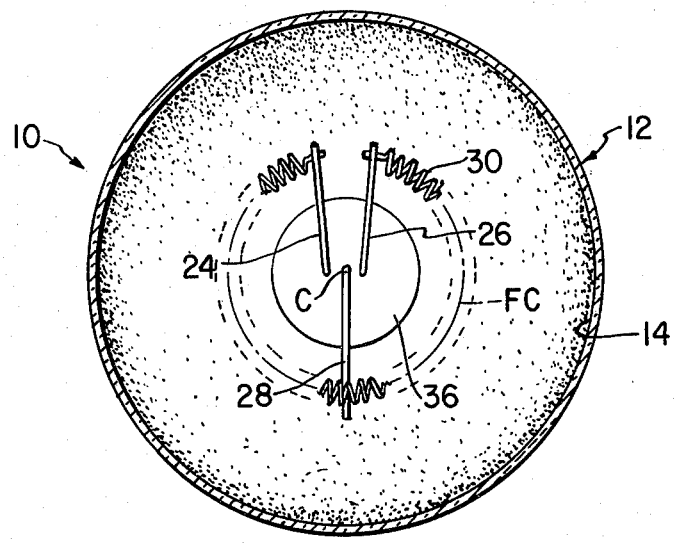
FIG. 1B is a top view of the lamp of FIG. 1A.

Referring to FIGS. 1A and 1B, there is shown an incandescent lamp 10 having an envelope 12 of lime glass, PYREX, or any other suitable glass material, the exact nature of which is not critical to the subject invention so long as it is capable of transmitting light in the portion of the visible range of concern. The shape of the envelope 12, as viewed in elevation, is an ellipse. As described below, in some cases, the drawings may be exaggerated as to the shape of the ellipse. The ellipse has two foci, designated f1 and f2. The envelope is rotated about a center line C—C midway between the two foci f1, f2 as shown in FIG. 1A to form an ellipsoid. The major axis of the ellipsoid in FIG. 1A is shown in the horizontal plane perpendicular to C—C. As the ellipse is rotated, the two foci f1, f2 describe a circle FC as shown in FIG. 1B. That is, FC is the circle of an infinite number of conjugate focal points.

Located on all, or a substantial portion, of the wall of the envelope, either on the interior or exterior thereof, but preferably on the interior, is a coating 14 of a material which is reflective to IR energy, but transmissive to light energy over the complete visible range or over a selected portion thereof. Such material is called a heat mirror. Typical coatings are disclosed in the aforesaid patent to Thorington et al., which discloses a composite coating + formed of a film of metal sandwiched between two discrete films of an insulator material. In the coating of that patent, the metal is silver and the dielectric materials are titanium dioxide or magnesium fluoride. Such a coating has the capability of transmitting light over substantially all of the visible light range while reflecting IR energy. It is preferred that such coating have a high transmissivity (e.g. 60% and above on average) over the visible range and a high reflectivity (e.g. 60% and above on average) over the IR range.

Another coating, a so-called etalon coating, is disclosed in the aforesaid application to Peter Walsh. In this application, an etalon heat mirror coating is disclosed in which a film of a dielectric material, such as titanium dioxide or magnesium fluoride, is sandwiched between two discrete films of metal, such as silver. Another suitable type of coating is described in application Ser. No. 174,711, in the name of Peter Walsh, filed Aug. 1, 1980 which is also assigned to the assignee of the subject application. The coating of that application is also an etalon coating, but it is designed to transmit light only in a selected portion of the spectrum, for example, red, blue, green, etc., or over a wider band to produce "white" light.

While in FIG. 1 the coating 14 is located over the entire surface of the envelope, it should be understood that it need be used only in the area from which light is to be transmitted. In this case, the remainder of the wall of the envelope may be coated with a material, such as silver, gold or copper, which reflects both visible and infrared energy.

The envelope 12 has an opening near the bottom therein in which a neck portion 18 is formed. Attached to the neck and extending upwardly into the lamp is the stem 20 containing the tubulation 22. A pair of lead wires 24 and 26 extend upwardly from the stem and are attached to the ends of a filament 30, which is described in greater detail below. An insulated lead wire 28 also extends from the stem 20 and is used as a support for the filament. The filament 30 is curved, in a C or ring shape, and is mounted to the wires 24, 26, 28 with its ends electrically connected to lead wires 24, 26. The filament can be of any conventional type, for example, coiled or coiled-coil, and of any suitable material, for example, plain or doped tungsten.

The lead wires 24 and 26 exit through the stem, one making contact with a metal base member 32, shown illustratively as being screw-threaded and the other with a contact tip 34 at the bottom of the base.

If desired, a reflector 36 can be located on the stem in conformity with the shape of the envelope to substantially complete the reflecting optical surface of the envelope so that light emitted by the filament will not go into the neck portion of the base and disappear. The reflector 36 need be only reflective to IR energy since visible light cannot pass out through the base.

The interior of the lamp envelope is exhausted through the tubulation 22 which is tipped off in the usual way before the base 32 is applied onto the neck. Before tipping the envelope off, the lamp can be filled with any desired and suitable fill gas, for example, argon, krypton, mixtures of various gases, etc. depending upon the characteristics of the lamp.

While a particular more or less conventional base arrangement has been shown for the envelope 12, it should be understood that other types of base arrangements can be used. For example, a glass button base having the filament mounted thereon can be sealed directly into the opening in an envelope and contacts made to the glass button base.

As indicated, the envelope 12 is an ellipse which has been revolved about a center line C. Considering first the ellipse showing the cross-sectional shape of the envelope, such an ellipse would have two foci, at the points f1 and f2 as shown in FIG. 1A. Any ray of light emitted from portion of a filament located on a focal point, e.g. f1, would be transmitted to a point on the envelope from which the visible light will exit. The IR portion of the energy of the ray is reflected from the coating 14 back to the opposite focal point f2. If another portion of the filament were located at the focal point f2, then the IR energy emitted from point f1 would be reflected onto focal point f2 with the only loss being the loss in the coating 14.

When the ellipse is rotated to form the overall ellipsoidal shaped envelope, an infinite number of focal points are produced, all of which lie on a circle FC whose center is the point C. A circular filament having the same diameter as the circle of focal points and located on such is effective in that energy radiated from any part of the filament which is on the focal circle is reflected by the coating and returned to the focal point which lies diametrically opposite on the circle from the point where the energy was radiated.

It can be shown that in an envelope of the type under consideration, that the aberrational losses are relatively small. Consider the case of a coiled filament which is a circle and has a radius R. The radius of a turn of the coil is given as r and the filament lies on the focal circle with the focal circle being coaxial with the center of the coil of radius r.

In the ellipsoidal envelope of FIG. 1, consider that S is the distance from the filament to the adjacent focal circle. By using some approximations it can be shown that the aberrational reflection factor f, that is, the fraction of those rays which are emitted from any point of the filament and which return to the filament on the first pass, that is, only one reflection from the envelope, is approximately equal to:

$$f \approx \frac{4Rr}{\pi^2 S^2},$$

when r is small. The aberrational reflection factor f is near unity when $$S = \frac{2}{\pi} \sqrt{Rr}$$

For S less than this value the simple approximations do not hold but f approaches closer to unity as S is reduced. Thus as a simple approximation, when $$S \lesssim \frac{2}{\pi} \sqrt{Rr}$$

only small abberrational losses will be encountered.

If a circular envelope is used, the focal circle reduces to a point at the center of the circle. In that case S is large for normal C-shaped filament and f is small. Thus very large aberration losses are found when C-shaped filaments are used in a circular envelope with a reflective coating. These losses are overcome by using an elliptical envelope, as disclosed, so that the filament lies everywhere near the focal circle, allowing S to be small.

Figure 2:
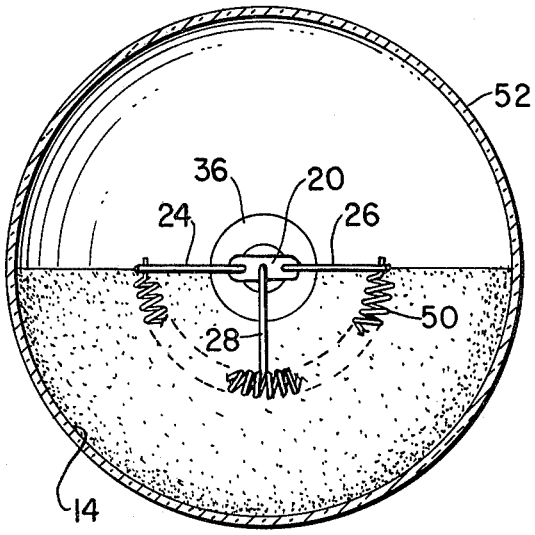
FIGS. 2 and 3 are top views of other embodiments of lamps showing different types of filaments and alternative coatings.

FIG. 2 shows another embodiment of the invention. As indicated previously, in some specialized applications such as a traffic signal lamp, it is only necessary to direct the light outwardly and more or less downwardly when the lamp fixture is located fairly high above the ground. In FIG. 2 the filament 50 is in the shape of a semi-circle which would be oriented toward the bottom of the fixture when the lamp is inserted. Since light need not be transmitted out of the top half, or some other similar portion, of the envelope the coating on the portion which does not have to transmit light need not be light transmissive. Instead, another coating 52 for example, a thick film of metal such as silver or other material which is highly reflective to IR is provided. Here, the IR portion of the rays from the filament must make two reflections from the envelope wall to return to the same point on the filament from which it left. It should be understood that since there is no upper half for the filament that a ray from a focal point f1 has no conjugate focal point f2 to land on and must be again reflected from the envelope to return to f1. Therefore, the use of a highly reflective metal 52 provides more efficient return of the rays toward the filament and to the lower half of the envelope which is coated with the IR reflective and light transmissive coating 14. The metallic film further reduces the cost of the envelope. The increased IR reflectivity of a metal only coating as compared to a coating of thin film further increases the efficiency of the lamp.

If the curved filament is not wound in an exact circle or portion of a circle, the IR energy from a given light ray must make at least two reflections from the envelope coating before returning to the original point of production of the ray rather than to the focal point opposite itself on the circle. Deliberate off-centering of the filament can be somewhat advantageous from the point of view of eliminating certain of the manufacturing problems which are inherent with attempting to try to precisely center a filament on the focal circle. However, the efficiency of such a lamp would be reduced somewhat depending upon the degree of off-centering. An incandescent lamp with heat mirror coating and an off-centered filament is described in U.S. patent application Ser. No. 952,267, filed Oct. 18, 1978, now U.S. Pat. No. 4,249,101 granted Feb. 3, 1981, which is also assigned to the assignee.

The portion of the envelope coated with a metal film 52 can alternatively be the upper portion of the lamp of FIG. 1, the lower portion of the lamp of FIG. 1, or the lower portion of the lamp of FIG. 2, when light is to exit from the top portion in this last arrangement. Where these arrangements are utilized, in which a portion of the envelope is coated with a metal rather than with the IR reflective-visible transmissive material, such portion has higher reflectivity to IR energy thereby tending to offset the reduction in efficiency due to off centering the filament.

Figure 3:
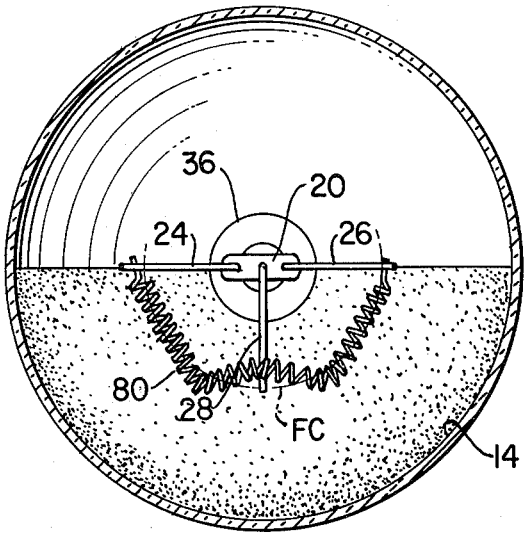

It should be understood that the filament need not be totally curved. FIG. 3 shows a modified version of the filament 80 in which the focal circle FC is shown in dotted line and the filament is made generally W-shaped. As seen, a major portion of the filament 80 lies along the focal circle FC so that substantial gains are obtained. In addition, even those portions which lie off the focal circle still will receive some returned radiation, particularly if the distance off the focal circle is less than $$(2/\pi)\sqrt{Rr}\ .$$

It should be understood that in a typical lamp, the envelope would appear to the eye to be more or less spherical and, therefore, the envelope shapes of the drawings may be considered to be somewhat exaggerated. For example, in a lamp in which the radius of a circular filament is approximately 18 mm and it was desired to locate such filament on the focal circle of an ellipsoidal envelope, the overall dimensions of the envelope would be approximately 59 mm along the line CC of FIG. 1 and approximately 62 mm on a line transverse to the line CC. Thus, the envelope of such a lamp would appear to the eye to be generally spherical.

Figure 4:
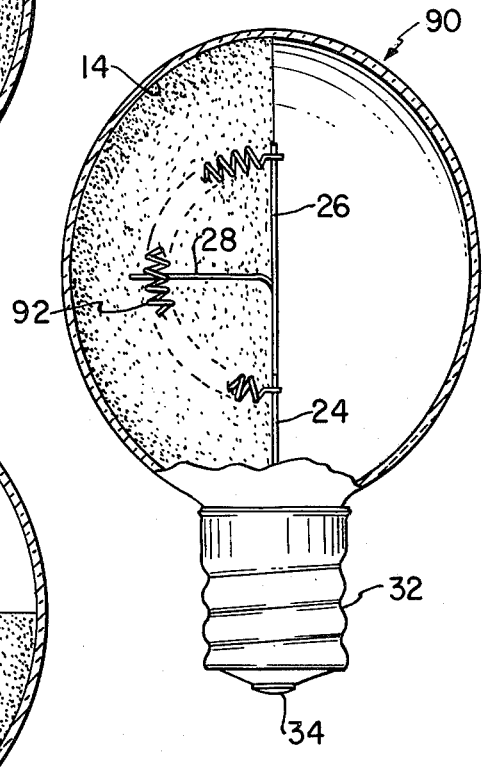
FIG. 4 is an elevational view of a further embodiment of a lamp.

While the filaments of the lamps are shown as being horizontal with the base of this envelope in a downward direction, an envelope can be made in which the filament extends vertically with the base down. This is shown in FIG. 4. Here the filament 92 is generally C-shaped. The envelope has been rotated to a position where the plane of the focal circle lies in the paper.

What is claimed is:

1. An incandescent electric lamp comprising an envelope of material which is transmissive to visible light, said envelope having the shape of an ellipse rotated about an axis to define an ellipsoid with a plurality of foci located on a circle and defining a focal circle, means on the major portion of said envelope for reflecting radiant energy in the infrared range, at least a portion of said envelope transmitting energy in the visible light range, a filament within said envelope which incandesces upon the application of current thereto to produce and radiate energy in both the visible and the infrared range, said filament located on or closely adjacent to said focal circle and in substantially the same plane as said focal circle, means for supplying current to said filament, the infrared radiant energy radiated by the filament from any one point on the focal circle being reflected by said reflecting means to intercept such filament at a point on or closely adjacent to said focal circle.

2. An incandescent lamp as in claim 1 wherein at least a part of said filament is curved with the curved portion lying on or closely adjacent to said focal circle.

3. An incandescent lamp as in claim 2 wherein said filament is in the shape of at least a part of a circle which lies generally on or adjacent to said focal circle.

4. An incandescent lamp as in claim 1 wherein said filament is generally W-shaped with the various portions of the filament lying adjacent to said focal circle.

5. An incandescent lamp as in claim 1 wherein said reflecting means comprises a coating on said envelope having a portion which also transmits visible light therethrough, the portion of said reflecting means which transmits visible light being located over substantially the entire surface area of the envelope.

6. An incandescent lamp as in claim 1 wherein said reflecting means comprises a coating on said envelope, said coating having a portion which transmits visible light located on a portion of said envelope, the reflecting means on remaining portion of the envelope being non-transmissive to visible light.

7. An incandescent lamp as in either of claims 5 or 6 wherein the light transmissive portion of said coating transmits light within a certain wavelength band to produce a selected color.

8. An incandescent lamp as in claim 7 wherein said coating is a composite of three discrete films of a film of an insulating material sandwiched between films of metal.

9. An incandescent electric lamp comprising:

an envelope of material which is transmissive to visible light, said envelope having the shape of an ellipse rotated about an axis to define an ellipsoid with a plurality of foci located on a circle and defining a focal circle, means on the major portion of said envelope for reflecting radiant energy in the infrared range, at least a portion of said means transmitting energy in the visible light range, a filament within said envelope which incandesces upon the application of current thereto to produce and radiate energy in both the visible and the infrared range, said filament having an overall shape generally conforming to at least a part of said focal circle but located off of said focal circle in a plane closely adjacent to the plane of the focal circle, means for supplying current to said filament, infrared radiant energy radiated by the filament from one point being reflected back to the same point on the filament after at least two reflections from said reflective means.

10. An incandescent lamp as in claim 9 wherein said reflecting means comprises a coating on said envelope, the portion of said reflecting means which transmits visible light is located on a portion of said envelope, the reflecting means on remaining portion of the envelope being non-transmissive to visible light.

11. An incandescent lamp as in claim 10 wherein the light transmissive portion of said coating transmits light within a certain wavelength band to produce a selected color.

12. An incandescent lamp as in claim 1 wherein said filament is generally C-shaped with the open part of the filament having an image which lies on or closely adjacent to said focal circle and in substantially the same plane as said focal circle.

* * * * *